United States Patent [19]

Trefethern et al.

[11] Patent Number: 4,480,568

[45] Date of Patent: Nov. 6, 1984

[54] PROPELLED PONTOON CHAIR

[76] Inventors: George M. Trefethern, P.O. Box 2787, Bonita Springs, Fla. 33923; Marian J. Bissell, 711 Banyan Blvd., Naples, Fla. 33940

[21] Appl. No.: 472,142

[22] Filed: Mar. 4, 1983

Related U.S. Application Data

[63] Continuation of Ser. No. 240,777, Mar. 5, 1981, abandoned.

[51] Int. Cl.[3] ..... B63B 1/12

[52] U.S. Cl. ..... 114/61; 114/163; 440/6; 434/262

[58] Field of Search ..... 114/61, 315, 270, 163; 440/26-31, 6; 441/130; 188/83; 434/262

[56] References Cited

U.S. PATENT DOCUMENTS

| | | | |
|---|---|---|---|
| 996,444 | 6/1911 | Yarrington | 114/61 |
| 1,789,415 | 1/1931 | Phillips | 440/6 |
| 2,509,001 | 5/1950 | Johnson | 440/28 |
| 3,083,382 | 4/1963 | Havens et al. | 114/61 X |
| 3,522,788 | 8/1970 | Montague, Jr. | 440/6 |
| 3,554,329 | 1/1971 | Shimano | 188/83 |
| 3,982,497 | 9/1976 | Caron | 114/270 |
| 4,089,291 | 5/1978 | Craig | 114/270 |
| 4,166,462 | 9/1979 | Ellis | 114/315 |
| 4,303,033 | 12/1981 | King | 114/61 |

FOREIGN PATENT DOCUMENTS 543439 7/1957 Canada .

*Primary Examiner*—Sherman D. Basinger
*Attorney, Agent, or Firm*—Oldham, Oldham, Hudak & Weber

[57] ABSTRACT

A recreational and therapeutic propelled pontoon chair. The invention fundamentally comprises a pair of pontoons in fixed spaced relationship with each other. A chair for maintaining a user is positioned between the pontoons with a drive and power source being maintained behind the chair. A control box for controlling the propulsion speed of the pontoon chair is provided at one of the user's hands while a friction locking rudder mechanism is provided at the other. The user achieves the physical benefit of water movement across his lower extremities while obtaining the psychological benefit of actually controlling a physical apparatus.

11 Claims, 4 Drawing Figures

PROPELLED PONTOON CHAIR

This is a continuation of application Ser. No. 240,777, filed Mar. 5, 1981, now abandoned.

TECHNICAL FIELD

The invention herein resides in the art of recreational and therapeutic water vehicles. Particularly, the invention pertains to such a vehicle of the pontoon type.

BACKGROUND ART

The therapeutic effect of water flowing across an individual's flesh has been known for many years. Indeed, the physically handicapped and those suffering from temporary physical disabilities have often been exposed to a turbulent water source to provide a stimulus to affected muscle and circulatory areas. For this purpose, whirlpool baths have been known for many years.

It has further been known that persons with mental or physical disabilities find great satisfaction in being able to control and maneuver a vehicle. THe patient achieves mental stimulation from the awareness he obtains from his own ability to render control over the vehicle. By providing an operator-controlled water vehicle which exposes portions of the user's body to the water, applicant has found that it is possible to achieve both mental and physical stimulation of the patient.

Water vehicles of the type adapted for a single user have been previously known in the art. Applicant is aware of the teachings of U.S. Pat. Nos. 2,752,617; 3,117,327; and 4,115,888. However, the buoyant chairs of these patents are not intended for therapeutic purposes and fail to provide the physical stimulus desired for therapeutically aiding the handicapped person. These devices could be unstable and, if the same were to be used by one with a physical disability, would pose a dangerous instrumentality, if not properly constructed.

DISCLOSURE OF INVENTION

In light of the foregoing, it is an object of the instant to provide a propelled pontoon chair capable of exposing the user's lower extremities to the water upon which the chair is caused to move.

Another object of the invention is to provide a propelled pontoon chair which allows the operator to control the movement of the same through the water.

An additional object of the invention is to provide a propelled pontoon chair which is of stable construction, safely securing the user in a partially immersed state, while protecting the user from the dangers of the water.

Yet a further object of the invention is to provide a propelled pontoon chair which is durable and reliable in operation, simple and inexpensive to construct, and readily adapted for obtaining beneficial physical and psychological effects on the user.

The foregoing and other objects of the invention which will become apparent as the detailed description proceeds are achieved by a recreational and therapeutic device, comprising: a pair of pontoons interconnected in fixed spaced relationship to each other; a chair maintained between said pontoons; propulsion means positioned rearwardly of said chair and between said pontoons for propelling the device across and atop a body of water; and control means adjacent said chair and interconnected with said propulsion means for controlling the course and speed of the device.

BRIEF DESCRIPTION OF DRAWINGS

For a complete understanding of the objects, techniques, and structure of the invention, reference should be had to the following detailed description and accompanying drawings wherein.

BEST MODE FOR CARRYING OUT THE INVENTION

Figure 1:
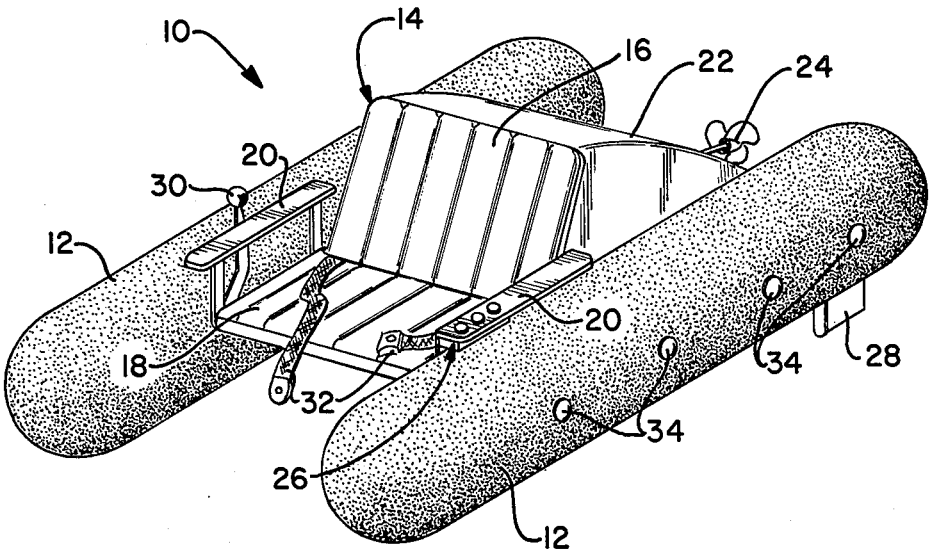
FIG. 1 is a perspective view of the propelled pontoon chair of the invention.

Referring now to the drawings and more particularly FIG. 1, it can be seen that a propelled pontoon chair made in accordance with the invention is designated generally by the numeral 10. A pair of pontoons 12 is interconnected in fixed spaced relationship to each other and maintains therebetween a chair 14. This chair may be supported on a frame interconnecting the pontoons. It will be appreciated that the pontoons 12 are provided for buoyancy and, to that end, may be constructed of Styrofoam. To prevent the Styrofoam from becoming saturated with water, the pontoons 12 may be sealed with a silicon coating, or appropriately covered with a light vinyl or Visqueen material or water-base acrylic polymer paint. Solid pontoon construction is preferred over that of inflatable pontoons for obvious safety reasons. Additionally, it is preferred that the pontoons be of such size and character that they will not submerge more than half of their depth into the water, guaranteeing stability and flotation.

The chair 14 includes an adjustable back 16 and a seat 18, both being preferably cushioned. With the back 16 being adjustable as to its angle with the seat 18, various positions of the patient or other user of the device 10 may be obtained. The chair 14 also includes arms 20 on each side of the seat 18 for purposes of supporting and maintaining the user.

A flexible cover 22 interconnects the seat back 16 and the frame interconnecting the pontoons 12 as shown. The cover 22 is preferably of the accordion type, having a plurality of collapsible ribs for achieving the desired structure. The accordion nature of the cover 22 accommodates the adjustability of the seat back 16. The purpose of the cover 22 is to shield or seal the propulsion power source of the assembly 10 from the water upon which the assembly is to be maintained. Both the drive motor and the power source for the same may be maintained within this cover 22, such motor driving a propeller 24 in standard water-engaging fashion. For safety purposes, it is preferred that the propeller 24 be of a soft, pliable, plastic construction, sufficient to achieve propulsion within the water, and yet soft enough to eliminate the possibility of physical harm. The rotational speed of the propeller 24 may be controlled by an appropriate control box 26 maintained on one of the arms 20. As will be appreciated hereafter, the control box 26 may include a plurality of pushbuttons, or a slide lever, to allow the operator to select the propeller speed and, accordingly, the rate of travel of the pontoon chair 10.

At the end of each of the pontoons 12 is a rudder 28. As will be elaborated upon hereafter, the rudders 28 are controlled via a rudder control stick 30 handily positioned in juxtaposition to one of the arms 20. The control box 26 and control stick 30 afford the user complete control of the pontoon chair 10 at the user's fingertips. Finally, seat belts 32 are provided in association with the chair 14 and in preferable interconnection with the frame of the assembly 10 to assure maintenance of the user in a proper and safe position.

Figure 2:
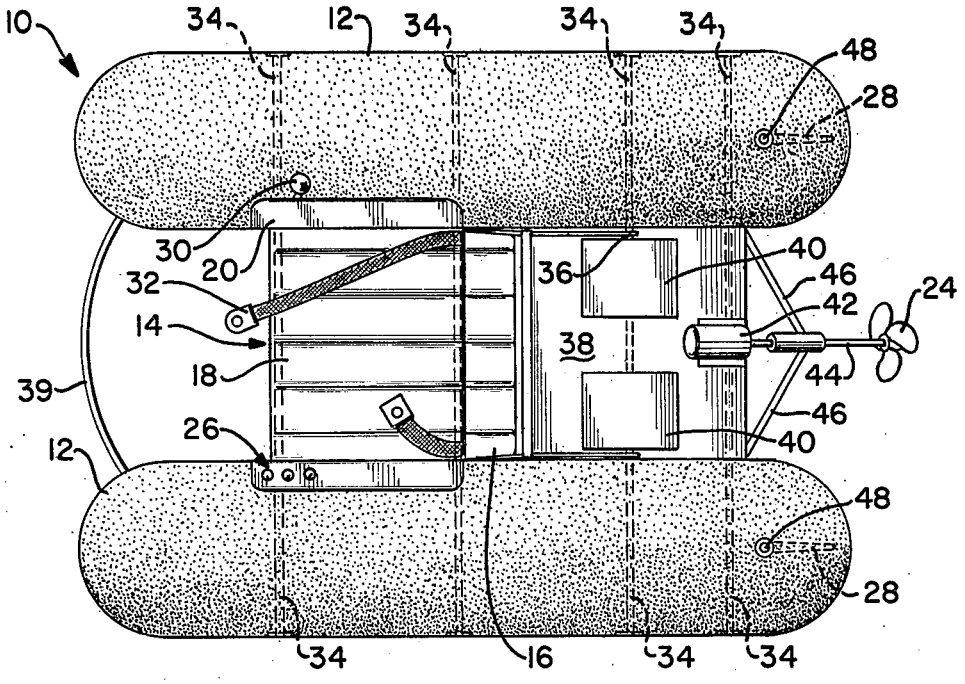
FIG. 2 is a top plan view of the propelled pontoon chair of the invention.

With reference now to FIG. 2, it can be seen that the pontoons 12 are maintained in their fixed relationship by a plurality of rods 34 passing therebetween. The rods 34 each have a head at one end thereof and are threaded at the other to receive a nut. The heads and nuts are preferably maintained in recessed areas of the pontoons 12 so as not to provide a dangerous protrusion. Each of the rods 34 passes through a sleeve or spacer 36 which is maintained between the pontoons 12 to obtain the desired fixed spaced relationship thereof. The sleeves 36 are of larger diameter than the bores in the pontoons 12 which receive the rods 34. In a preferred embodiment of the invention, a base or frame board 38 is provided atop the spacers 36 for receiving thereon the chair 14 and the propulsion means to be described hereinafter. The front edge of the seat 18 is spaced rearwardly from the front edge of the pontoons 12 a distance of approximately 18 inches for protection of the user's knees. A plastic mesh or knee guard 39 may be provided for additional protection if desired.

As is further shown in FIG. 2, a pair of batteries 40 may be maintained on the frame 38 and in selective interconnection with the DC motor 42. This selective interconnection may be achieved via the control box 26 described above. In any event, the DC motor 42 is connected to a propeller shaft 44 for driving the propeller 24. As shown, a pair of braces 46 are attached to a sleeve for receiving the shaft 44, in somewhat standard fashion. The braces 46 are preferably interconnected in some manner to the base or frame 38.

It will be appreciated that if the motor 42 is a DC motor and the batteries 40 are of equal size, the control box 26 may be used to interconnect the batteries 40 with the motor 42 in either parallel or series connection. In such manner, the voltage applied to the motor 42 is either halved or doubled, thereby regulating the propulsion speed of the pontoon chair 10.

Figure 3:
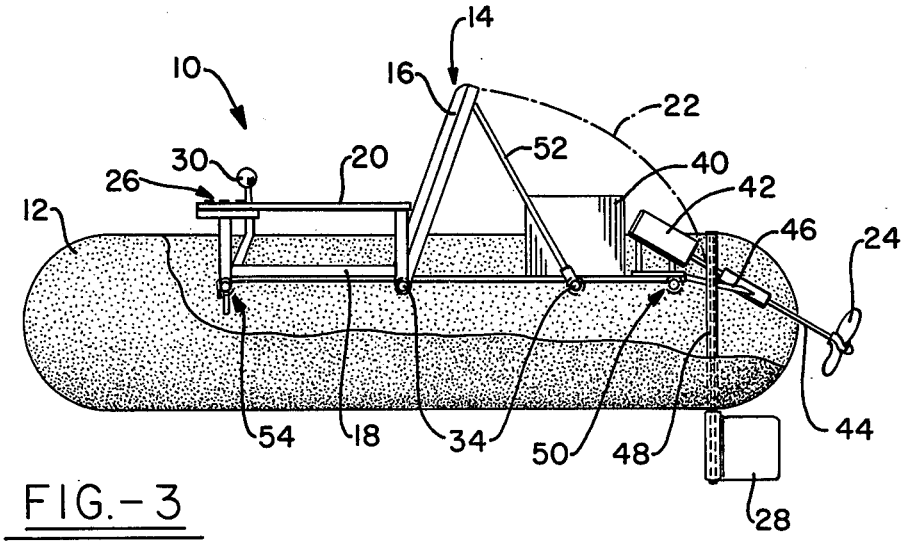
FIG. 3 is a side elevational view of the propelled pontoon chair of the invention.

With reference to FIGS. 2 and 3, it can be seen that the rudders 28 are connected to appropriate rudder shafts 48 passing through the rearward ends of the pontoons 12. The shafts 48 are operative in a manner to be discussed hereinafter to control the rudders 28 in tandem to achieve the desired navigation of the assembly 10. It will also be noted from FIG. 3 that the motor 42 and propeller shaft 44 may be hingedly connected to the frame 38 for safety purposes, allowing the motor and propeller to swing upwardly when an obstruction is contacted. Such hinged connection is illustrated as by numeral 50. It will also be noted from FIG. 3 that the seat back 16 has connected thereto an adjustable support rod 52 for achieving the desired changes in inclination of the back 16. Finally, this figure illustratively shows the rudder control linkage 54 discussed directly below.

Figure 4:
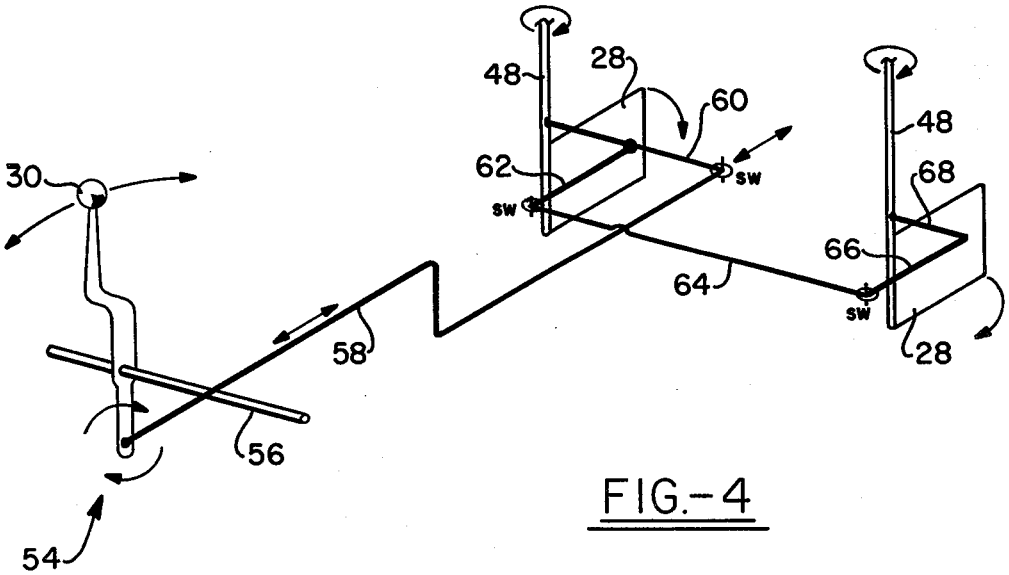
FIG. 4 is a pictorial illustration of the rudder assembly used in conjunction with the propelled pontoon chair of the invention

As shown in FIG. 4, the rudder control stick 30 is interconnected with the linkage 54 as at a pivot rod 56. It will be appreciated that the rod 56 could, indeed, be one of the connection rods 34 discussed hereinabove. In any event, the engagement between the stick 30 and the rod 56 is a frictional one, achieving a frictional locking at any position selected by the operator until moved from that position. The end of the stick 30 is connected to a drive linkage or rod 58 which is then connected by a swivel connection to a connecting rod 60 for direct interconnection with one of the rudders 28. Fixedly connected to the connecting rod 60 is the rod 62. Similarly, a connecting rod 68 is provided in fixed interconnection with the other rudder 28 and has fixedly extending therefrom a connecting rod 66. The connecting rods 62, 66 communicate with each other and operate in tandem by swivel connections to a common connecting rod 64. In operation, movement of the stick 30 causes a corresponding movement of the rod 58 which then achieves tandem movement of the rudder assemblies 28 by means of the rod linkages 60–68.

In use, an operator may sit within the chair 14, having the back 16 positioned at any desired comfortable position. The seat belt 32 is then used to safely secure the user within the chair. At the operator's fingertips are a control box 26 for regulating the speed and direction of the rotation of the propeller 24, and a rudder control stick 30 for steering the device 10. The operator thus has complete control over the pontoon chair 10 achieving the mental benefit of such control. As the chair 10 moves through the water, the user's legs dangle in the water and achieve the benefit of the stimulation of the water passing thereacross. Additionally, when used in the outdoors, the user achieves the benefit of sunlight and fresh air.

In its preferred embodiment, the seat 18 of the chair 14 is maintained two to four inches above the centerline of the pontoons 12, with the waterline preferably being at such centerline when in use. Further, the positioning of the batteries 40 rearwardly of the assembly 10 and the user forwardly thereof, and with the assembly 10 being symmetric about a line drawn between the pontoons 12, the center of gravity of the assembly 10 closely approximates the geometric center of the assembly, providing for an extremely stable device.

It will be appreciated by those skilled in the art that the invention is preferably constructed of noncorrosive elements, such as rubber, plastic, aluminum, and the like. It will further be appreciated that certain modifications and substitutions may be made in the structure of the invention. For example, it is presently contemplated that the DC motor 42 could, indeed, be an air motor, with the batteries 40 being replaced by an air cylinder. Such a change, as well as those which will become apparent to those skilled in the art, is contemplated as comprising a portion of the invention.

Thus it can be seen that the objects of the invention have been satisfied by the structure presented hereinabove. While in accordance with the patent statutes only the best mode and preferred embodiment of the invention has been presented and described in detail, it is to be understood that the invention is not limited thereto or thereby. Accordingly, for an appreciation of the true scope and breadth of the invention, reference should be had to the following claims.

What is claimed is:

1. A recreational and therapeutic device, comprising:

a pair of pontoons interconnected in fixed spaced relationship to each other;

a chair having a seat and an adjustable back, said seat being maintained between said pontoons and in horizontal alignment therewith;

propulsion means positioned rearwardly of said chair and between said pontoons for propelling the device across and atop a body of water;

first control means adjacent said chair and interconnected with said propulsion means for controlling the speed of the device; and second control means adjacent said chair for controlling the course of the device, said second control means comprising a pair of rudders connected through a linkage to a control stick, said control stick being pivotally maintained and frictionally lockable upon a rod, said friction locking securing positioning of said rudders during movement of the device in water.

2. The device as recited in claim 1 wherein said propulsion means comprises a motor in driving engagement with a propeller.

3. The device as recited in claim 2 wherein said first control means comprises a voltage selector for selectively connecting predetermined voltage sources to said motor.

4. The device as recited in claim 2 wherein said motor is connected through said control means with a battery, said motor and battery being maintained beneath a cover for shielding from water.

5. The device as recited in claim 4 wherein said cover is collapsible by folding upon itself.

6. The device as recited in claim 2 wherein said propulsion means comprises an air motor in interconnection with a regulatable air source.

7. The device as recited in claim 1 wherein each said pontoon has a rudder thereon, said rudders being connected in tandem to said linkage.

8. A water vehicle for recreational and therapeutic uses, comprising:

a pair of pontoons in fixed spaced parallel relationship to each other;

a chair having a seat and a back, said seat being maintained between said pontoons and in substantial horizontal alignment therewith;

a motor in driving engagement with a propeller, said motor and propeller being maintained rearwardly of said chair;

a pair of rudders, one associated with and maintained at an end of each of said pontoons, said rudders being commonly connected to a linkage for operation in tandem, said linkage being driven by a control under operator control, said control stick being frictionally lockable and pivotal about a rod, such frictional locking securing said rudders against movement when the device is operated in water; and a guard extending between said pair of pontoons at a first end thereof.

9. The vehicle according to claim 8 wherein said motor is a DC motor selectively energized by preselected voltages from a voltage source.

10. The vehicle according to claim 8 wherein said motor is an air motor.

11. The vehicle according to claim 8 wherein the center of gravity of the vehicle is substantially the same as the geometrical center thereof.

* * * * *